US012304769B2

(12) United States Patent
Lechner

(10) Patent No.: US 12,304,769 B2
(45) Date of Patent: May 20, 2025

(54) WINDING MACHINE FIXING MECHANISM, WINDING MACHINE AND METHOD FOR COUPLING AND/OR DECOUPLING A WINDING SLEEVE TO OR FROM A WINDING SPINDLE OF A WINDING MACHINE

(71) Applicant: Starlinger & Co. Gesellschaft m.b.H., Vienna (AT)

(72) Inventor: Gerhard Lechner, Altenmarkt an der Triesting (AT)

(73) Assignee: Starlinger & Co. Gesellschaft m.b.H., Vienna (AT)

( * ) Notice: Subject to any disclaimer, the term of this patent is extended or adjusted under 35 U.S.C. 154(b) by 0 days.

(21) Appl. No.: 18/637,778

(22) Filed: Apr. 17, 2024

(65) Prior Publication Data

US 2024/0262651 A1 Aug. 8, 2024

Related U.S. Application Data

(63) Continuation of application No. PCT/EP2023/081596, filed on Nov. 13, 2023.

(30) Foreign Application Priority Data

Dec. 8, 2022 (EP) ..... 22212151

(51) Int. Cl.
*B65H 75/24* (2006.01)
*B65H 54/54* (2006.01)

(52) U.S. Cl.
CPC ..... *B65H 75/2484* (2021.05); *B65H 2553/25* (2013.01)

(58) Field of Classification Search
CPC ..... B65H 54/543; B65H 75/2484; B65H 75/248; B65H 75/245; B65H 75/242;
(Continued)

(56) References Cited

U.S. PATENT DOCUMENTS 1,882,950 A 9/1932 Rulon
2,623,710 A 12/1952 Edgar
(Continued)

FOREIGN PATENT DOCUMENTS

CH 165 476 A 11/1933
DE 3723592 A1 * 1/1989 ..... B65H 54/547
(Continued)

OTHER PUBLICATIONS www.federnfabrikschmid.com/de/ballonfedern, accessed May 30, 2024.

*Primary Examiner* — Sang K Kim
*Assistant Examiner* — Katelynne R Burrell
(74) *Attorney, Agent, or Firm* — The Sladkus Law Group

(57) ABSTRACT

The invention relates to a winding machine (1) with a winding machine fixing mechanism (44) for fixing a winding sleeve (4) on a winding spindle (3). The winding machine fixing mechanism (44) can be actuated by use of a motion control. By this motion-controlled actuation, the winding machine fixing mechanism (44) can be transferred from the release position into a fixing position and/or from a fixing position into a release position. During the motion control, a catch (5) is entrained by the movement of the winding sleeve (4). This catch then causes the actuation of the winding machine fixing mechanism (44).

25 Claims, 10 Drawing Sheets

(58) Field of Classification Search
CPC ..... B65H 75/2455; B65H 75/2209; B65H 54/547; B65H 67/00; B23B 31/2073; B21C 47/30
USPC ..... 242/597.3, 573, 573.1, 573.2, 573.7, 242/573.9; 279/2.04, 2.01, 2.09
See application file for complete search history.

(56) References Cited

U.S. PATENT DOCUMENTS 2,652,989 A * 9/1953 Warwick ..... B65H 81/08 242/597.3
3,463,519 A * 8/1969 Charles ..... B65H 54/543 403/111
4,084,762 A * 4/1978 Repp ..... B65H 16/04 242/571.3
4,375,278 A * 3/1983 Beeck ..... B65H 75/2455 242/597.5
5,775,631 A * 7/1998 Murakami ..... B65H 18/04 242/573.9
10,577,217 B1 3/2020 Feng
10,967,660 B2 * 4/2021 Ji ..... B41J 33/003
11,731,854 B2 * 8/2023 Kim ..... B65H 75/247 242/571
2006/0180699 A1 * 8/2006 Cranston, III ..... B65H 16/005 242/571
2018/0326765 A1 * 11/2018 Ji ..... B65H 16/04

FOREIGN PATENT DOCUMENTS

JP 2009-012870 A 1/2009
WO WO-2008052565 A1 * 5/2008 ..... B65H 75/242
WO WO-2017215881 A1 * 12/2017 ..... B23B 31/207

* cited by examiner

WINDING MACHINE FIXING MECHANISM, WINDING MACHINE AND METHOD FOR COUPLING AND/OR DECOUPLING A WINDING SLEEVE TO OR FROM A WINDING SPINDLE OF A WINDING MACHINE

CROSS REFERENCE TO RELATED APPLICATIONS

This application is a continuation of International Application PCT/EP2023/081596 with an international filing date of Nov. 13, 2024 and claiming priority to co-pending European Patent Application No. EP 22 212 151.9 entitled "Spulmaschinen-Fixiermechanismus, Spulmaschine und Verfahren zum Koppeln und/oder Entkoppeln einer Spulenhülse mit oder von einer Spulspindel einer Spulmaschine", filed on Dec. 8, 2022.

FIELD OF THE INVENTION

The invention relates to a winding machine that is intended for winding a winding good made of any winding material and with any winding material cross-section, particularly a thread shaped or ribbon or band shaped winding material. Furthermore, the invention relates to a winding machine fixing mechanism that serves to fix a winding sleeve on a winding spindle. Here, the winding sleeve can also be embodied as a drum sleeve with limiting disks arranged at the front sides. In the context of the invention, the fixing of the winding sleeve can merely mean an axial fixing of the winding sleeve on the winding spindle. Alternatively or cumulatively, the fixing may include fixing of the orientation of the winding sleeve coaxially to the longitudinal axis of the winding spindle and/or a fixing in the circumferential direction for transmitting a drive torque of a driven winding spindle. The invention also relates to a method for torque-proof coupling of a winding sleeve to a winding spindle of a winding machine and/or for decoupling a winding sleeve from a winding spindle of a winding machine.

BACKGROUND OF THE INVENTION

In known winding machines, clamping of a winding sleeve takes place by use of a lever that is actuated manually, electrically, pneumatically or hydraulically. By actuating the lever, a pressing of clamping spring elements against an inner surface of the winding sleeve can be caused that evokes the friction required to transfer the drive movement of the driven winding spindle to the winding sleeve. If the bobbin with the winding wound on the winding sleeve is to be removed from the spindle at the end of the winding cycle, a reverse actuation of the lever takes place, thereby releasing the winding sleeve again.

It is known from U.S. Pat. No. 2,623,710 A and the website www.federnfabrikschmid.com/de/ballonfedern to equip spindles with balloon springs that surround the spindle in the manner of an elastic cushion. In a non-biased state, the balloon springs have an outer diameter that is larger than the inner diameter of the winding sleeve. When sliding the winding sleeve onto the balloon springs, the balloon springs are elastically deformed radially inwards, whereby the pressing force of the balloon springs against the inner surface of the winding sleeve and thus the clamping of the winding sleeve is achieved.

JP 2009-012870 A discloses a winding machine fixing mechanism in which a winding sleeve is clamped from the inside in the end region facing the winding machine by fixing elements. The fixing elements are blades arranged uniformly distributed around the circumference of a spindle, the blades being biased radially inwards by rubber rings in a release position. On the spindle, a catch is held in a bayonet-like locking in a release position despite of the bias by a spring. When the winding sleeve is slid onto the spindle, the front face of the winding sleeve facing the winding machine comes into contact with a conical lateral surface of the catch. The bayonet-like locking of the catch can be released by pressing the winding sleeve and thus the catch against the bias by the spring and by rotating the winding sleeve with the catch. The spring then presses the catch into the interior of the front face of the winding sleeve facing the winding machine. The blades thereby slide along the grooves of the conical lateral surface of the catch, whereby these are spread apart and pressed against the inner surface of the winding sleeve. In the fixing position brought about in this way, the bobbin is frictionally secured by pressing the blades against the inner surface of the winding sleeve.

U.S. Pat. No. 1,882,950 A discloses a winding machine fixing mechanism in which fixing levers distributed uniformly around the circumference are mounted pivotably about a pivot axis on a head comprising a flange. An end region of a first lever part of the fixing lever facing away from the flange has a contact element which serves for being pressed radially outwards as a result of the pivoting motion of the fixing lever against the inner surface of the winding sleeve. The other lever part of the fixing lever facing the flange has an actuating slant. If the winding sleeve is slid onto the actuating slant, this causes the pivoting motion of the fixing lever, whereby the winding sleeve frictionally contacts via the inner surface on the one hand the actuating slant and on the other hand the friction element.

CH 165 476 A discloses a clamping head for a winding sleeve with a conical inner surface. In a fixing position, the conical inner surface of the winding sleeve contacts a corresponding conically shaped outer surface of a support body. Fixing the axial relative position between the winding sleeve and the support body is achieved by a tension spring that surrounds a support. When the winding sleeve is slid onto the support body, a movement of the support body against the bias of a spring supported on the support takes place. During this movement, the front face of the support body pushes the tension spring along a ramp surface of the support, whereby the tension spring is pressed radially outwards against the inner surface of the winding sleeve. The friction-locked securing of the axial position of the winding sleeve relative to the support body can be released by manually actuating a sliding bolt protruding from the winding sleeve in the fixing position, which results in an unlocking of locking balls that causes the release of the frictional connection between the tension spring and the inner surface of the winding sleeve.

According to U.S. Pat. No. 4,375,278 A, a frictional securing of a winding sleeve on a pressure sleeve mounted axially displaceably on a spindle against the bias of a spring is achieved by radial tensioning of O-rings with the inner surface of the winding sleeve.

U.S. Pat. No. 10,577,217 B1 discloses a winding machine fixing mechanism in which fixing elements embodied as leaf springs are pressed radially outwards under an increase of the curvature of these leaf springs against an inner surface of a winding sleeve in order to frictionally secure the winding sleeve. The increase of the curvature of the leaf springs is achieved by use of a catch that is actuated by a front face of the winding sleeve and slides along the inner surface of the winding sleeve.

SUMMARY OF THE INVENTION

The invention proposes a winding machine fixing mechanism, a winding machine and a method for coupling a winding sleeve to a winding spindle and/or for decoupling a winding sleeve from a winding spindle, which is in particular improved with regard to

- the installation space conditions and/or
- the operational safety and/or
- the effort for coupling a winding sleeve to a winding spindle and/or decoupling the winding sleeve from the winding spindle.

In some cases the use of a lever for fixing and releasing a winding machine fixing mechanism primarily used in accordance with the prior art can be disadvantageous, since this requires that not only a sliding of the winding sleeve onto the winding spindle and pulling the winding sleeve off the winding spindle (manually, electrically, pneumatically or hydraulically) is to be induced, but also the lever has to be actuated. In addition, in order to increase output, the aim is to arrange the largest possible number of winding machines in a working area of a factory hall of a given size, so that the winding machines must be arranged as close as possible to each other and/or on top of each other. As the lever is usually arranged in the area of the machine frame, there must remain a space between the spindles and the bobbins winded thereon of two neighboring winding machines that can be used to actuate the lever.

A winding machine fixing mechanism is proposed by which a winding sleeve can be fixed on a winding spindle. This fixing can alternatively or cumulatively fulfill the following functions:

- determining an axial position of the winding sleeve in at least one direction in the manner of providing a stop and/or
- axial clamping of the winding sleeve and/or
- radial clamping of the winding sleeve and/or
- specification of an orientation of the winding sleeve relative to a longitudinal axis of the winding spindle.

An actuation of the winding machine fixing mechanism can in one embodiment be achieved by use of a motion control. By this motion control, an actuation of the winding machine fixing mechanism from a release position, in which the winding sleeve can be slid onto the winding spindle, to a fixing position can take place. In the fixing position achieved in this way, winding of the bobbin can then take place. Alternatively or cumulatively, an actuation from the fixing position to the release position (in which the winding sleeve (possibly with the winding wound thereon) can be pulled off the winding spindle) can be achieved by the motion control.

In the motion control a catch (which also covers a follower or carrier) can be used which causes the actuation of the winding machine fixing mechanism is entrained by the movement of the winding sleeve. Here, the movement of the winding sleeve is the axial sliding on movement of the winding sleeve onto the winding spindle. The catch is thus entrained with at least one axial component, whereby the catch can certainly be entrained according to any curve path, as long as this curve path comprises an axial component. It is also possible that the catch is designed as a pivoted lever that is pivoted with an axial component by the movement of the winding sleeve. Preferably, the entrainment of the catch is achieved by the movement of the winding sleeve exclusively in the axial direction, so that the catch is mounted with a linear guide in the direction of the longitudinal axis of the winding spindle, for example displaceable relative to the winding spindle.

One embodiment is also based on the realization that when the winding sleeve is clamped by the balloon springs mentioned at the beginning, there is a mandatory dependence between

- the force required to slide the winding sleeve onto the winding spindle and to pull the winding sleeve off the winding spindle and
- the clamping force that depends on the coefficient of friction between the balloon spring, the radial oversize of the balloon spring compared to the inner diameter of the winding sleeve and the radial stiffness of the strip-shaped spring elements of the balloon spring. If doubling of the tensioning force of the winding sleeve shall be achieved by the design for such balloon springs, this leads to a doubling of the force required for sliding on and pulling off.

In some cases, this dependency can be resolved in particular by the motion control as a result of the catch being entrained by the movement of the winding sleeve and further measures of the winding machine fixing mechanism, which will be explained below.

Fixing the winding sleeve to the winding spindle can be achieved by a fixing device.

In one embodiment, the fixing device comprises a spreading element and at least one fixing element or several spreading elements with associated fixing elements. In this case, at least one fixing element is in contact with the spreading element, the contact taking place via at least one slanted surface of the spreading element and/or fixing element. A movement of the catch that is caused by the movement of the winding sleeve, brings about a relative movement between the spreading element and the fixing element, the relative movement then being guided by the slanted surface. As a result of the slanted surface, the distance of the fixing element from a longitudinal axis of the winding spindle changes with the relative movement. Thus, the fixing element comprises a larger distance from the spindle axis in the fixing position than in the release position. It is possible that, as a result of this change in distance, the fixing element is pressed radially from the inside against the winding sleeve, whereby a certain elasticity of the fixing element or in the flow of force to the fixing element can also be used to ensure contact pressure. The fixing element can comprise a fixing section that is, after sliding on the winding spindle, arranged behind the winding sleeve in the direction for sliding on. In this case, the fixing section is arranged radially on the outside of the inner diameter of the winding sleeve, whereby this fixing section forms an axial stop for the winding sleeve that prevents sliding the winding sleeve off the winding spindle. The impact on the fixing section of the fixing element can also be such that the fixing section exerts an axial force on the winding spindle, that can axially clamp it between the catch and the fixing element. It is also possible for this embodiment that a type of wedge or cone connection is provided by the spreading element and the at least one fixing element, which are in operative connection with each other via the slanted surface in the fixing position, that ensures a particularly reliable fixing of the winding sleeve, whereby, depending on the choice of the angle of the slanted surface, a type of self-inhibition or self-locking of this wedge or cone connection can also be used and/or a force transmission can be brought about.

While it is generally possible that the fixing device comprises only one fixing element which extends only over a partial circumferential area or extends completely in the circumferential direction and is expanded radially during actuation, according to one embodiment of the winding machine fixing mechanism the fixing device comprises several fixing elements distributed (uniformly or non-uniformly) over the circumference of the winding spindle. These fixing elements can then be pressed radially inwards against a circumferential surface of the winding spindle via a spring device that may consist of one or more springs, for example a circumferential spring extending in a closed manner in the circumferential direction around the fixing elements. The fixing elements can then comprise slanted surfaces in one end region that interact with the or a spreading element. Preferably, the at least one spreading element has slanted surfaces whose angles of inclination correspond to the angle of inclination of the slanted surfaces of the fixing elements.

For a further proposal, the catch can be supported by an actuating spring. The actuating spring is biased by a movement of the winding sleeve in a direction for sliding on by the force for sliding on exerted by the winding sleeve on the catch. The energy stored in the actuating spring in this way during sliding on can then be used for an actuating stroke (following the sliding on stroke) to actuate the fixing device, which then results in the fixing device being actuated from the release position to the fixing position and/or being actuated from the fixing position to the release position.

In one embodiment the flow of force between the catch and the fixing device runs via a motion link unit. The motion link unit causes, for example, a change of a distance of the catch, an actuating part or a front face of an actuating sleeve from the aforementioned spreading element.

For example, a so-called "ball pen motion link unit" can be used for the design of the motion link unit, that is described under this keyword on various websites that can be found under the keyword "ball pen mechanism", "ball point pen mechanism" or "pen exchange". A ball pen mechanism is characterized in particular by the fact that the actuating button on the end of the ball pen is moved against an actuating spring in a sliding on stroke against a spring that causes an opposite actuating stroke of the actuating button after the pressure force applied to the actuating button has been removed. By this sliding on stroke of the push-button and this actuating stroke of the push-button, the ball point pen cartridge can be extended from an inoperative position inside the ball pen casing, the extended position being fixed. For retracting the ball point pen cartridge, a further sliding on stroke by the user's thumb on the actuating button is caused with renewed biasing of the actuating spring with subsequent return movement of the actuating button caused by the actuating spring in a new actuating stroke. A corresponding mechanism with a basically corresponding interaction between a motion link body and a motion link can also be used for the winding machine fixing mechanism. However, here instead of the actuation of the actuating button by the operator, the actuation of the catch takes place by sliding the winding sleeve in the direction for sliding on with the force for sliding on against the catch and the movement of the ball point pen cartridge into an extended position and into a retracted position corresponds to the movement of a front face of an actuating sleeve between two positions that correspond with different distances of the front face of the actuating sleeve from a spreading element. Thus, any ball pen mechanisms known per se can be used.

In one embodiment the motion link unit comprises a motion link and a motion link body moving along the motion link. Here, the motion link body can be designed as a motion link pin, for example, while the motion link unit can be designed as a motion link sleeve, wherein the motion link is then a circumferential motion link that extends along the circumference of the motion link sleeve. The motion link pin can then engage in the circumferential motion link in a radial direction.

It is possible that the motion link unit defines a first axial position of the motion link body. In this first axial position, the fixing device is in its release position, so that it is possible for the winding sleeve to be slid on the winding spindle or pulled off the winding spindle in the first axial position. The motion link unit can also define a second axial position. In the second axial position, the catch is actuated by the winding sleeve, whereby the actuating spring is tensioned and an energy supply is created by which an actuation of the fixing device can be induced in an actuation stroke. The motion link unit then also comprises a third axial position of the motion link body. In the third axial position, the fixing device is in the fixing position, so that in the third axial position the winding sleeve is fixed, clamped or axially trapped on the winding spindle. Finally, the motion link unit defines a fourth axial position of the motion link body. In the fourth axial position (as also in the second axial position), the catch is actuated by the winding sleeve by the actuating spring. The energy stored in the actuating spring in this way can then be used to actuate the fixing device in an actuating stroke in such a way that it is returned from the fixing position to the release position.

It is possible here that the movement from the first axial position to the second axial position and from the third axial position to the fourth axial position is caused by the movement of the winding spindle in the direction for sliding on, so that this change in the axial position is brought about by the operator manually or by a device for moving the winding sleeve, possibly with the winding created on it, in the direction for sliding on. These movements thus create a supply of energy stored in the actuating spring. On the other hand, the movements from the second axial position to the third axial position and from the fourth axial position to the first axial position are caused by the actuating spring, so that the aforementioned energy supply stored in the actuating spring can be used for these movements.

Here, a distance of the catch from the spreading element may be larger in the first and third axial positions than in the second and fourth axial positions, which may result in an end face of an actuating sleeve from the spreading element being larger in the first and third axial positions than in the second and fourth axial positions. It is possible that (as previously mentioned as one option) the motion link is a circumferential motion link. In this case, a rotation of the circumferential motion link about the spindle axis can take place during the movement between the different axial positions.

There is a variety of different options for coupling the catch to the motion link unit and/or the fixing device. In one proposal, the coupling of the catch to the motion link unit and/or the fixing device takes place via an actuating part that may, for example, comprise catching pins, an actuating rod and an actuating sleeve. In this case, a sensor can detect the position and/or movement of the actuating part so that information on the operating state of the winding machine fixing mechanism can be obtained via the sensor. For example, it may be determined by the sensor whether the winding machine fixing mechanism is in the release position or in the fixing position. The sensor can be an analog or digital sensor that detects the movement of the actuating part in the form of detecting a displacement and/or a speed of the actuating part. It is also possible that the sensor is embodied as a switch with two or more discrete switching positions, wherein the switching positions can then correlate with the different axial positions or the fixing position and release position.

Preferably, the actuating part comprises an actuating rod. The actuating rod can comprise an end region that extends (for all operating positions or only in one operating position or several operating positions) out of an inner bore of the winding spindle. The sensor can then detect the position and/or movement of the end region protruding from the inner bore of the winding spindle. Thereby, the sensor can be arranged in the area of the machine frame, here particularly on the side of the machine frame facing away from the winding and/or the associated front face of the winding spindle.

In one embodiment a winding machine comprises a winding machine fixing mechanism as explained above.

Preferably, for the motion control the catch forms a positive fit with the front face of the winding sleeve in the direction for sliding on. The catch is designed separately from the actuating spring. No relative sliding movement between the catch and the winding sleeve takes place during the sliding on movement.

Also a method is proposed by which a winding sleeve can be fixed (preferably torque-proof) on a winding spindle. For this purpose, the winding sleeve is moved on the winding spindle in a direction for sliding on, preferably towards the machine frame. Thereby, the winding sleeve is pressed against the catch with a force for sliding on in the direction for sliding on. This results in moving the catch in the direction for sliding on, with an increase of the bias of the actuating spring. If the force for sliding on is then reduced or eliminated, the actuating spring can cause an actuating stroke in which the actuating spring actuates the fixing device in such a way that it is transferred from the release position to the fixing position.

In an alternative or cumulative embodiment, in a method for releasing a winding sleeve on a winding spindle, a movement of the winding sleeve on the winding spindle in a sliding on stroke is induced. During this movement, the winding sleeve is pressed with a force for sliding on in the direction for sliding on against the catch. As a result of this force for sliding on, the catch is moved in the direction for sliding on with an increase of the bias of the actuating spring. If the force for sliding on is then reduced or eliminated, the actuating spring can cause an actuating stroke in which the actuating spring actuates the fixing device in such a way that it is transferred from the fixing position to the release position.

During the aforementioned processes, preferably a movement of the catch (and the winding sleeve in contact with it) takes place in opposite axial directions during the sliding on stroke and the actuating stroke.

Advantageous developments of the invention result from the patent claims, the description and the drawings.

The advantages of features and of combinations of a plurality of features mentioned in the description only serve as examples and may be used alternatively or cumulatively without the necessity of embodiments according to the invention having to obtain these advantages.

The following applies with respect to the disclosure—not the scope of protection—of the original application documents and the patent: Further features may be taken from the drawings particularly from the illustrated designs and the relative dimensions of a plurality of components with respect to one another as well as from their relative arrangement and their operative connection. The combination of features of different embodiments of the invention or of features of different patent claims independent of the chosen references of the claims is also possible, and it is motivated herewith. This also relates to those features that are illustrated in separate drawings, or which are mentioned when describing them. These features may also be combined with features of different claims. Furthermore, it is possible that features disclosed in the patent claims do not apply to further embodiments of the invention, however, this does not hold true for the independent claims of the granted patent.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to the features mentioned in the patent claims, or may be the only features comprised by the subject of the respective patent claim.

The reference signs contained in the patent claims are not limiting the scope of the subjects protected by the patent claims. They only serve the purpose to make the claims easier to understand.

BRIEF DESCRIPTION OF THE DRAWINGS

In the following, the invention is further explained and described with reference to preferred embodiments shown in the Figures.

DETAILED DESCRIPTION

In the Figures, some components or parts thereof are partially labelled with the same reference numbers, if they correspond or are similar in terms of geometry and/or function. In this case, the components or parts thereof can then be distinguished from one another by the additional letters a, b, . . . . Reference can then be made to these components or parts thereof with or without the use of the additional letter, wherein one of the components or parts, several of the components or parts or all of the components or parts can then be addressed without the use of the supplementary letter.

Figure 1:
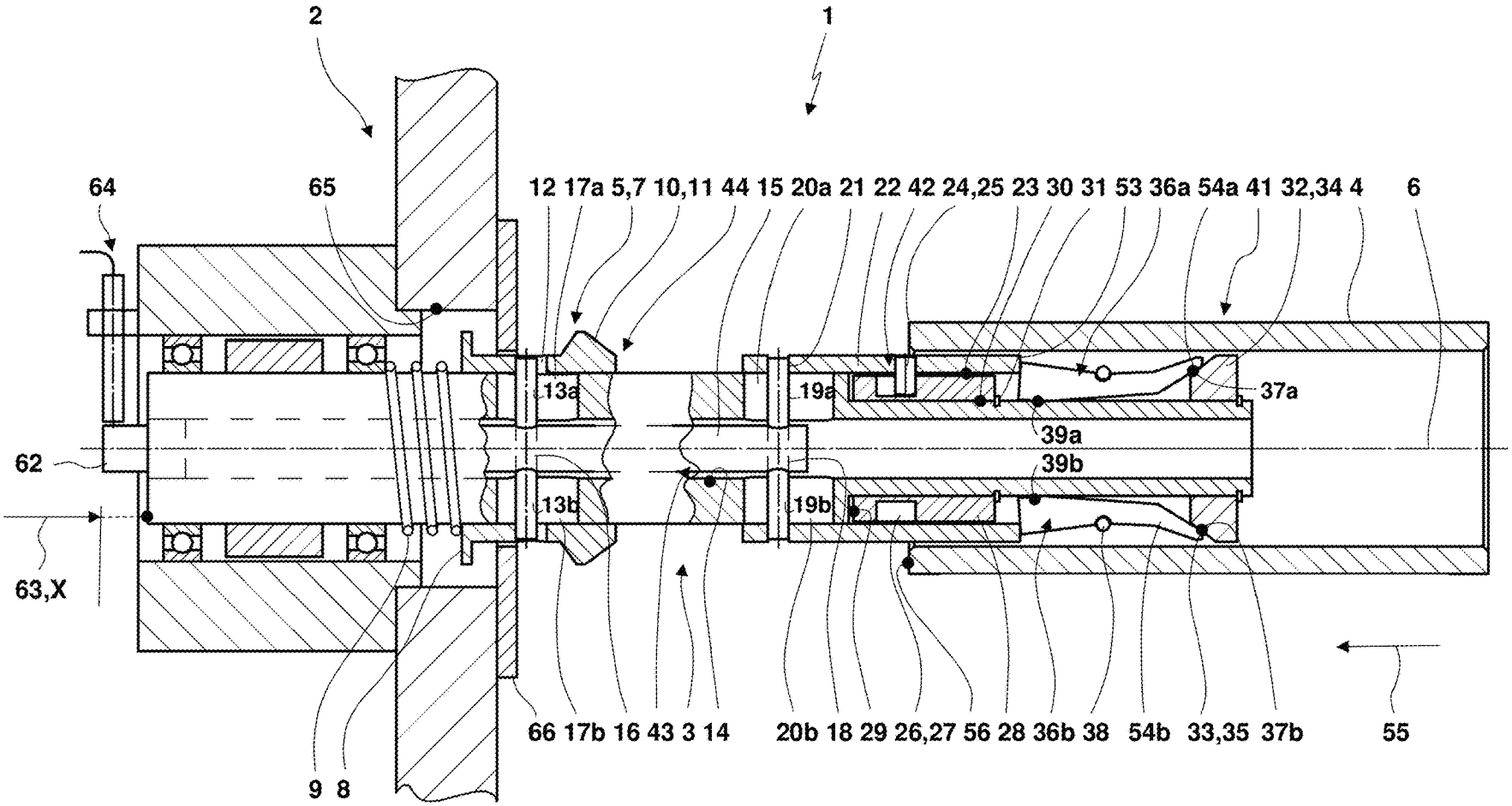
FIG. 1 schematically shows a section of a winding machine in the area of a winding machine fixing mechanism, wherein the winding machine fixing mechanism is in a release position and the winding sleeve is slid onto the spindle.

In the following, the structure of a winding machine is explained with reference to FIG. 1, wherein the components of the winding machine are primarily marked in FIG. 1. In contrast, FIGS. 1, 3, 5, 7 and 9 show the winding machine in different operating positions, while FIGS. 2, 4, 6, 8 and 10 show a motion link unit of the winding machine for these different operating positions.

FIGS. 1, 3, 5, 7 and 9 show a winding machine 1. The winding machine 1 has a machine frame 2. A winding spindle 3 is mounted for being rotated relative to the machine frame 2. The winding spindle 3 can be driven by a motor in a manner not shown here for winding the winding material. The winding spindle 3 protrudes from the machine frame 2 in the manner of a flying bearing, so that a winding sleeve 4 can be slid onto the winding spindle 3.

In the exit area of the winding spindle 3 from the machine frame 2, a catch 5 is mounted on the winding spindle 3, here via a slide bearing, so that it can be displaced to a limited extent in the direction of a longitudinal axis 6, which corresponds to the axis of rotation of the winding spindle 3. In the shown embodiment, the catch 5 is embodied as a catching sleeve 7. At the end region arranged in the machine frame 2 the catching sleeve 7 comprises a supporting surface 8 formed by the front face. A spring base of an actuating spring 9 is supported on the supporting surface 8 of the catching sleeve 7. The other spring base of the actuating spring 9 is supported on the winding spindle 3, here via an inner bearing ring of a roller bearing of the bearing of the winding spindle 3. The other end region of the catching sleeve 6 forms a contact surface 10 for the winding sleeve 4. In the embodiment shown, the contact surface 10 is embodied as a contact cone 11.

Between the end regions and on diametrically opposite sides, the catching sleeve 7 has elongated holes 12 that run through in the radial direction and that extend parallel to the longitudinal axis 6. Radially oriented catching pins 13*a*, 13*b* are accommodated in the elongated holes 12 and guided such that between the catching pins 13*a*, 13*b* and the catching sleeve 7 there is only one translational degree of freedom in the direction of the longitudinal axis 6, the length of which is predetermined by the length of the elongated holes 12, while no relative rotation about the longitudinal axis 6 is possible.

The winding spindle 3 has a continuous inner bore 14. An actuating rod 15 extends inside the inner bore 14. The actuating rod 15 protrudes from the winding spindle 3 in the end region of the winding spindle 3 arranged in the machine frame 2, while the other end region ends inside the winding spindle 3 (approximately in the middle). The actuating rod 15 has a transverse bore 16 in which the catching pins 13*a*, 13*b* are received and fixed. The catching pins 13*a*, 13*b* extend through elongated holes 17*a*, 17*b* of the winding spindle 3. The elongated holes 17 are radially continuous through the wall of the winding spindle 3 and extend in the direction of the longitudinal axis 6. The catching pins 13 extend through the elongated holes 17 of the winding spindle 3 into the elongated holes 12 of the catching sleeve 7. The catching pins 13 ensure on the one hand that the drive movement of the winding spindle 3 is transmitted (free of play or with play) on the one hand to the actuating rod 15 and on the other hand to the catching sleeve 7. The elongated holes 17 enable an axial relative movement of the actuating rod 15 with the catching pins 13 (and thus also of the catching sleeve 7) with respect to the winding spindle 3. The movement of the actuating rod 15 in the axial direction can deviate from the axial movement of the catching sleeve 7 by an amount determined by the elongated hole 12.

In the end region facing away from the machine frame 2, the actuating rod 15 comprises a further transverse bore 18, in which catching pins 19*a*, 19*b* are arranged. Also in this area, the winding spindle 3 has elongated holes 20*a*, 20*b*, that are continuous in the radial direction in the wall of the winding spindle 3 and extend in the direction of the longitudinal axis 6. The catching pins 19*a*, 19*b* extend through these elongated holes 20. The outer end regions of the catching pins 19*a*, 19*b* are received in bores 21 of an actuating sleeve 22 and fixed therein. The actuating sleeve 22 forms a slide bearing 23 with the lateral surface of the winding spindle 3. The catching pins 19 ensure that a transmission of the rotary movement of the winding spindle 3 to the actuating rod 15 and the actuating sleeve 22 takes place without play or with limited play and that the axial movement of the actuating rod 15 corresponds to the axial movement of the actuating sleeve 22. The actuating rod 15, the catching pins 19 and the actuating sleeve 22 have an axial degree of freedom in the direction of the longitudinal axis 6.

In contrast to the previous description, the transmission of the rotary movement can only take place via one of the elongated holes 12, 17, so that there is no double fit.

The actuating sleeve 22 carries a motion link body 24. In the embodiment shown, the motion link body 24 is embodied as a motion link pin 25. The motion link pin 25 is fixed in a radial bore of the actuating sleeve 22. The motion link pin 25 does not protrude beyond the lateral surface of the actuating sleeve 22 and extends radially inwards from the actuating sleeve 22.

The motion link body 24 engages in a motion link 26, in this way a kind of ballpen motion link 67 being provided. In the embodiment shown, the motion link 26 is embodied as a circumferential slotted motion link 27 of a motion link sleeve 28.

The motion link sleeve 28 is rotatably mounted on the winding spindle 3, but without an axial degree of freedom. In the embodiment shown, the winding spindle 3 transits into a bearing surface 30 via a shoulder 29 with a reducing cross-section. The motion link sleeve 28 rests against the shoulder 29 on the side facing the machine frame 2. In the other direction, the motion link sleeve 28 rests against a securing ring 31 that is received in a groove of the winding spindle 3. The motion link sleeve 28 is thus trapped (particularly with a limited play or a transition fit) between the securing ring 31 and the shoulder 29.

A spreading element 32 is fixed in the free end region to the winding spindle 3. The spreading element 32 has a slanted surface 33 or bevel. In the embodiment shown, the spreading element 32 is embodied as a spreading sleeve 34, wherein the slanted surface 33 is here formed by a frusto-conical conical surface 35.

The actuating sleeve 22 protrudes slightly in the direction of the spreading element 32 beyond the motion link sleeve 28. In the space between the spreading element 32 and the end face of the actuating sleeve 22, a plurality of fixing elements 36 (of which two fixing elements 36*a*, 36*b* are shown in the Figures as examples) are arranged which are distributed over the circumference of the winding spindle 3. In a rough approximation, the fixing elements 36 can be embodied as hollow cylinder segments, the segment angle preferably being less than 90°, less than 70°, less than 60°, less than 50°, less than 40° or less than 30° and/or the wall of the hollow cylinder segments comprising a longitudinal section which (particularly as shown) deviates from a rectangular longitudinal section. The front face of the actuating sleeve 22 contacts the associated axial front faces of the fixing elements 36, so that the front face forms an actuating surface 53. In the other end region, the fixing elements 36 have slanted surfaces 37 that can be shaped to correspond to the slanted surface 33 of the spreading element 32 and particularly comprise the same angles of inclination. By a spring device 38 surrounding the fixing elements 36, the fixing elements 36 are pressed radially inwards against the lateral surface of the winding spindle 3 such that they contact the lateral surface of the winding spindle 3 with a contact surface 39*a*, 39*b*.

FIGS. 2, 4, 6, 8, 10 show a development 40 of the circumferential motion link 27 of the motion link sleeve 28. Here, the development 40 in the Figures can represent the entire development of the circumferential motion link 27 for a developed or circumferential angle of 360°. However, preferably the Figures only show a development 40 of the circumferential motion link 27 over a circumferential angle that is an integer divisor of the circumferential angle of 360°. Several identical developments 40 according to FIG. 6 can thus be arranged directly adjacent to each other in the circumferential direction. In both cases mentioned, the end regions of the circumferential motion link 27 in the development 40 shown are then arranged directly adjacent to each other and without any steps or kinks in between.

As will be explained in more detail below with regard to the mode of operation, a fixing device 41 is formed with the spreading element 32 and the fixing elements 36*a*, 36*b*. The motion link body 24 and the motion link 26 (and possibly also the actuating sleeve 22 and/or the motion link sleeve 28) together form a motion link unit 42. The catching pins 13, 19, the actuating rod 15 and the actuating sleeve 22 form a rigid actuating part 43 that is axially movable relative to the winding spindle 3 and/or the catching sleeve 7, but rotates with the winding spindle 3 and is rotatable relative to the motion link sleeve 28 and can also perform an axial movement relative to the motion link sleeve 28.

It is possible that (in deviation from the above explanation) the catching pins 13*a*, 13*b* and/or 19*a*, 19*b* are embodied as a single pin passing through the associated transverse bore 16, 18.

The catch 5, the actuating part 43, the motion link unit 42 and the fixing device 41 form a winding machine fixing mechanism 44, the operation of which is explained in the following.

As can be seen in the development 40 of the circumferential link, the circumferential link has a maximum 45, a minimum 46, a maximum 47 and a minimum 48 with regard to the axial position in the direction of the longitudinal axis 6 and in the direction of actuation of the fixing device 41, that are passed in this order by the motion link body 24. Here, the maxima 45, 47 preferably specify the same axial position of the motion link body 24. On the other hand, the minimum 46 is arranged less far in the axial direction for actuating the fixing device 41 than the minimum 48, so that the minimum 48 is an absolute minimum. In the context of the present patent application, the minimum 46 is referred to as the first axial position 49, the maximum 47 as the second axial position 50, the minimum 48 as the third axial position 51 and the maximum 45 as the fourth axial position 52.

The operation of the winding machine fixing mechanism 44 is explained in the following.

Figure 2:
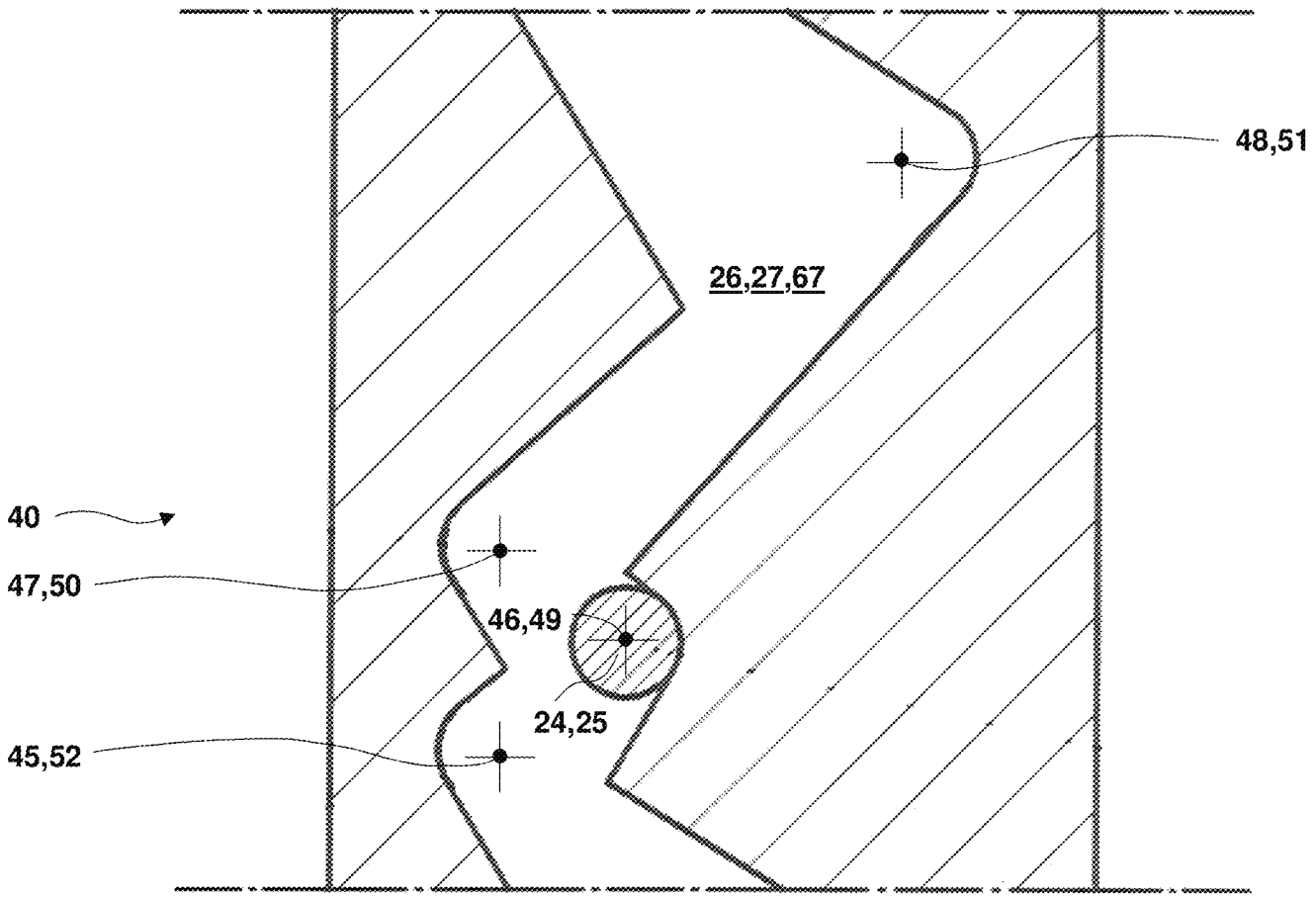
FIG. 2 shows a developed view of a motion link unit of a winding machine fixing mechanism of the winding machine according to FIG. 1, wherein a motion link body is located in a motion link in a first axial position.

In FIGS. 1 and 2, the winding machine fixing mechanism 44 is in the release position, in which the actuating part 43 has the greatest distance from the spreading element 32. As a result, the actuating surface 53 that is formed by the front face of the actuating sleeve 22 facing the spreading element 32 has a maximum distance from the spreading element 32. This in turn has the result that the fixing elements 36 can slide radially inwards along the slanted surface 33 of the spreading element 32 as a result of the bias by the spring device 38, which can be accompanied by an axial sliding movement of the fixing elements 36 along the contact surface 39*a*, 39*b* and/or a pivoting of the fixing elements 36 about the contact surface 39*a*, 39*b*. In the release position, a fixing section 54*a*, 54*b* is arranged at such a small distance from the longitudinal axis 6 that the winding sleeve 4 can pass the fixing sections 54*a*, 54*b* without contact. In this release position, the motion link body 24 is held in the first axial position 49 by the actuating spring 9 (possibly after overcoming any play as a result of the elongated hole 12), because the actuating spring 9 presses the motion link body 24 against the recess in the correspondingly shaped boundary of the circumferential motion link 27. In the release position, the winding sleeve 4 can thus initially be slid without any resistance onto the winding spindle 3, onto the motion link unit and onto the fixing device 41 in a direction for sliding on 55.

Figure 3:
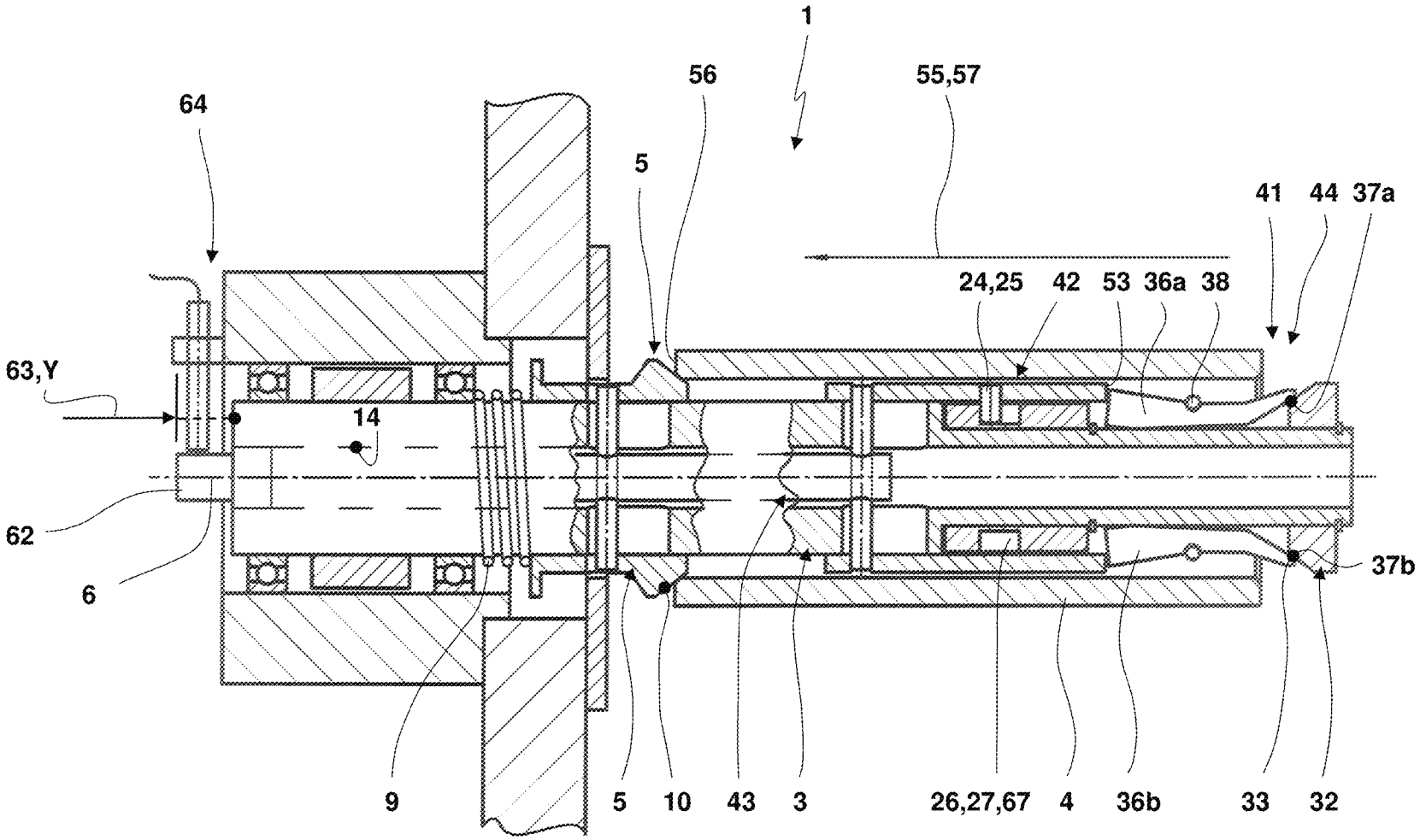
FIG. 3 shows the winding machine as shown in FIG. 1, wherein at the end of the winding sleeve sliding on operation the winding sleeve has entrained a catch with a bias of an actuating spring.
Figure 4:
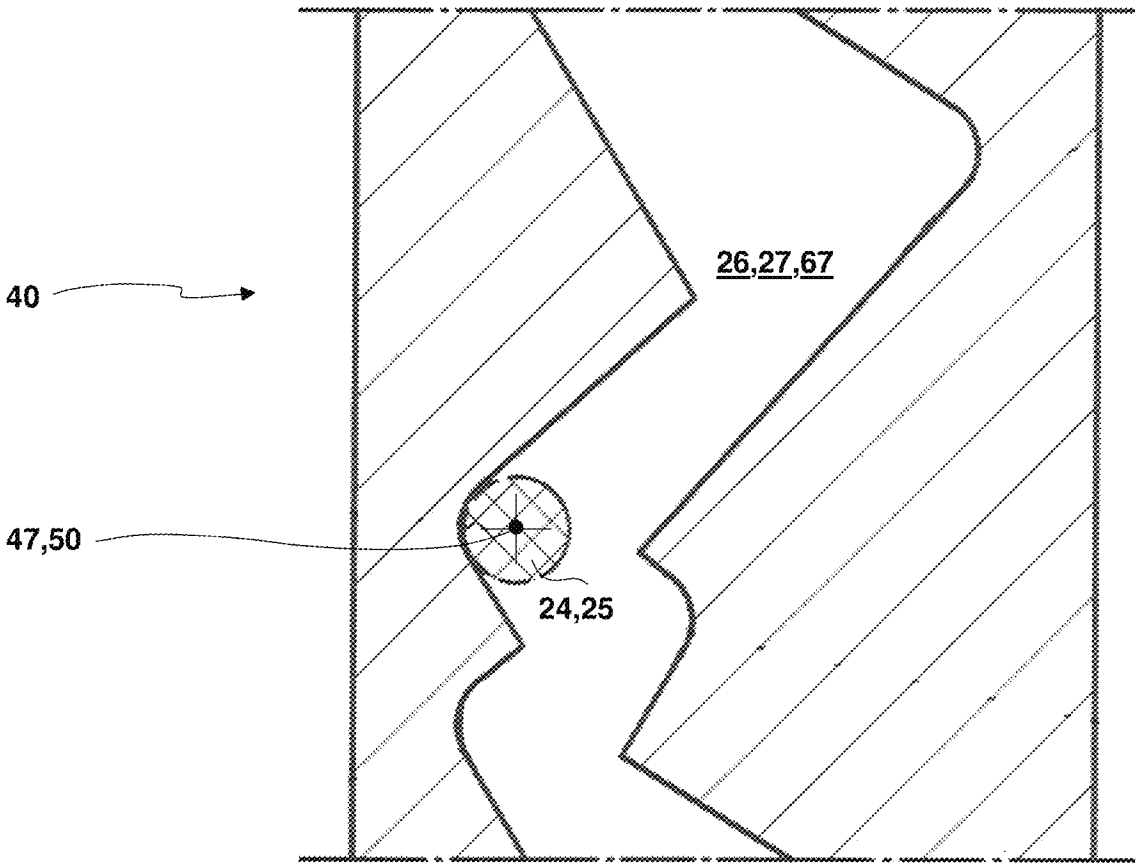
FIG. 4 shows a developed view of the motion link unit of the winding machine fixing mechanism of the winding machine according to FIGS. 1 and 3, wherein the motion link body is located in a second axial position of the motion link.

At the end of the sliding on process, a front face 56 of the winding sleeve 4 comes into contact with the contact surface 10 of the catch 5. If a force for sliding on 57 is then applied to the winding sleeve 4, an entraining movement of the catch 5 takes place with an increase of the bias of the actuating spring 9. The movement of the catch 5 (possibly after overcoming any play in the elongated hole 12) is transmitted via the catching pins 13 to the actuating part 43 and thus to the motion link body 24. As a result, the motion link body 24 can move in the circumferential motion link 27 from the first axial position 49 according to FIG. 2 to the second axial position 50 according to FIG. 4. FIGS. 3 and 4 show the second axial position 50 caused at the end of applying force for sliding on 57, which can thus also be referred to as the sliding on position. In the second axial position 50, the operating position of the fixing device 41 is still the release position.

Figure 5:
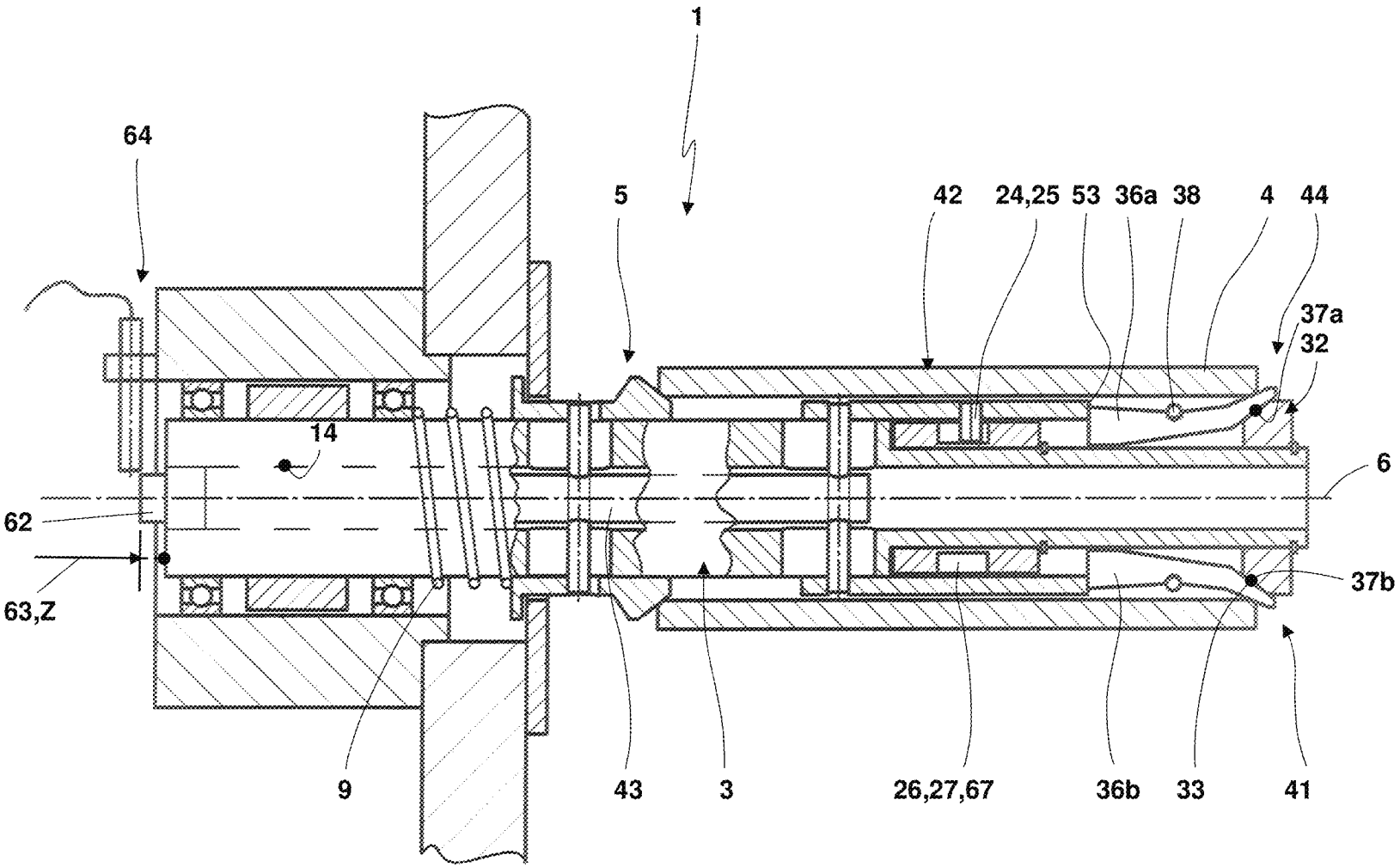
FIG. 5 shows the winding machine as shown in FIGS. 1 and 3, wherein the actuating spring has caused the fixing position of the winding machine fixing mechanism.
Figure 6:
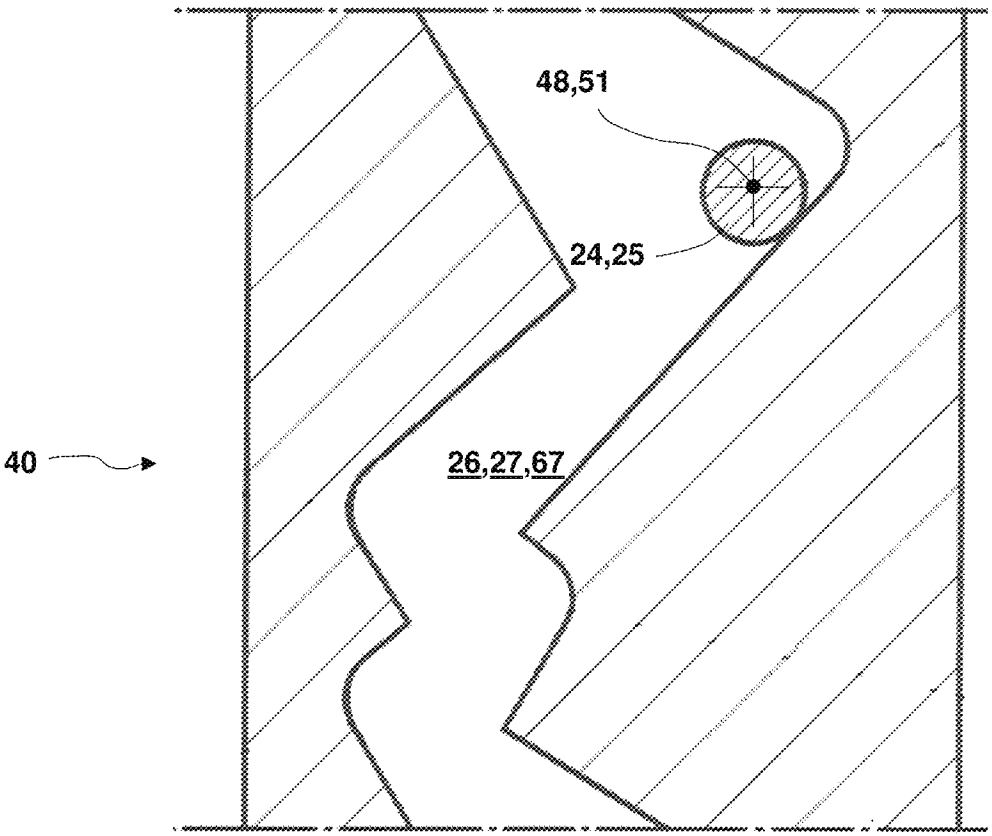
FIG. 6 shows a developed view of the motion link unit of the winding machine fixing mechanism of the winding machine according to FIGS. 1, 3 and 5, wherein the motion link body is located in a third axial position of the motion link.

If the force for sliding on 57 is then reduced or eliminated, the actuating spring 9 can cause the fixing position of the winding machine fixing mechanism 44 that is shown in FIGS. 5 and 6. For this purpose, the actuating spring 9 presses the catch 5 and thus the actuating part 43 in the direction of the spreading element 32. As a result, the motion link body 24 in the circumferential link 27 is moved from the second axial position 50 to the third axial position 51. In the third axial position, the distance of the actuating surface 53 of the actuating sleeve 22 from the spreading element 32 is minimal. As a result, the actuating force of the actuating spring 9, that is exerted by the actuating surface 53 on the fixing elements 36, causes the fixing section 54*a*, 54*b* to slide upwards along the slanted surface 33 of the spreading element 32 with its slanted surface 37*a*, 37*b*, the angle of inclination of which is adapted to the angle of inclination of the slanted surface 33 of the spreading element 32, thereby increasing the distance of the fixing section 54*a*, 54*b* from the longitudinal axis 6. This movement can be accompanied by an axial sliding movement in the region of the contact surface 39*a*, 39*b* and/or a pivoting of the fixing elements 36 about the contact surface 39*a*, 39*b*. In the fixing position according to FIG. 5, the end region of the fixing section 54*a*, 54*b* has a distance from the longitudinal axis 6 that is larger than the inner diameter of the winding sleeve 4. This in turn has the result that the winding sleeve 4 is axially trapped between the contact surface 10 of the catch 5 on the one hand and the slanted surface 33 of the spreading element 32 on the other hand and is thus axially fixed. On the other hand, the fixing section 54*a*, 54*b* also exerts a radially outwardly oriented force on the edge region of the winding sleeve 4, which can lead to clamping of the winding sleeve 4 from the inside, which can ensure further fixing or securing.

In the fixing position of the winding machine fixing mechanism 44 as shown in FIGS. 5 and 6, a winding 59 is then created on the winding sleeve 4.

Figure 7:
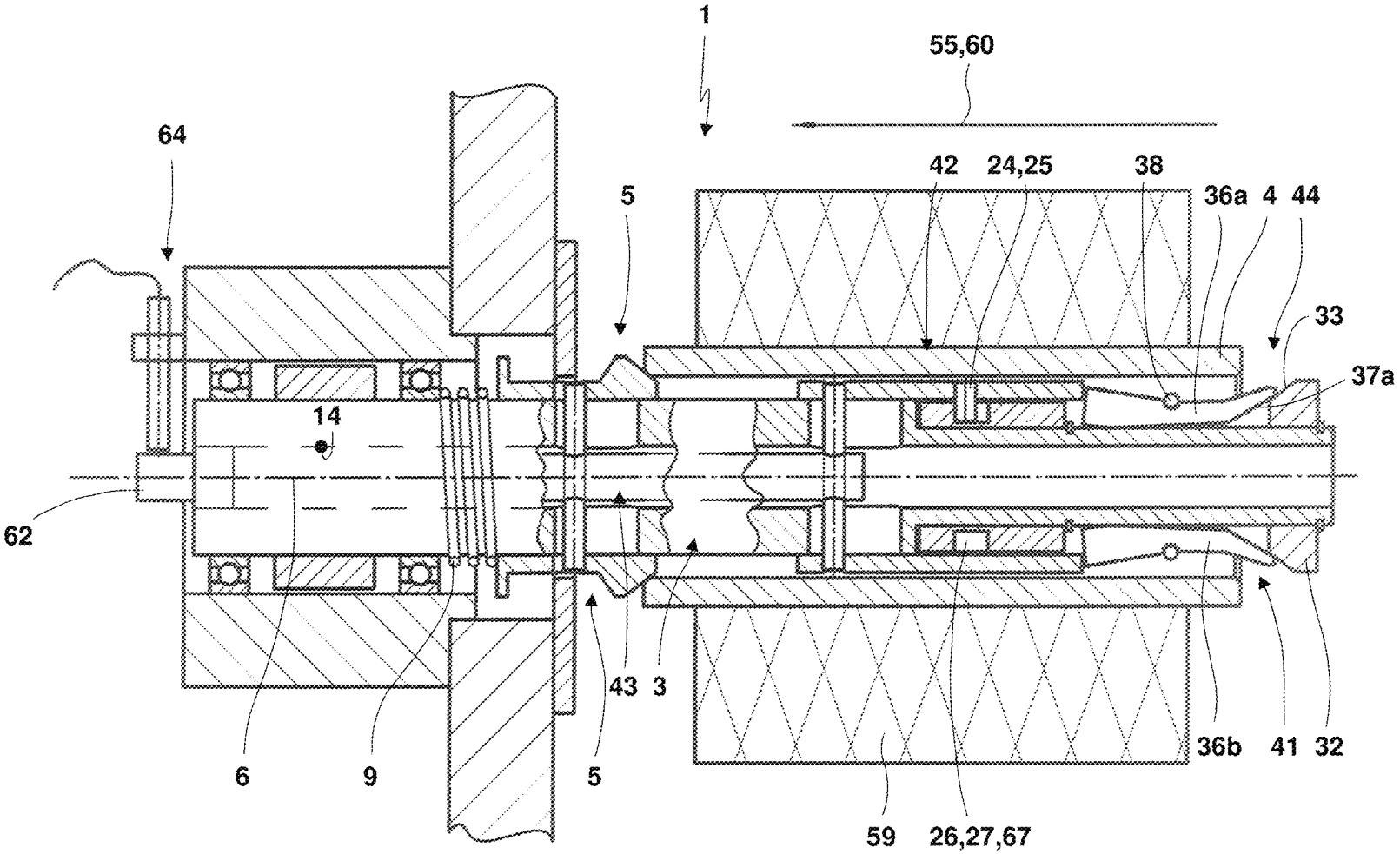
FIG. 7 shows the winding machine according to FIGS. 1, 3 and 5, wherein here, in order to transfer the winding machine fixing mechanism into the release position, the winding sleeve with the winding created on it has been pressed against the catch under a bias of the actuating spring and the actuating spring has caused the release position.
Figure 8:
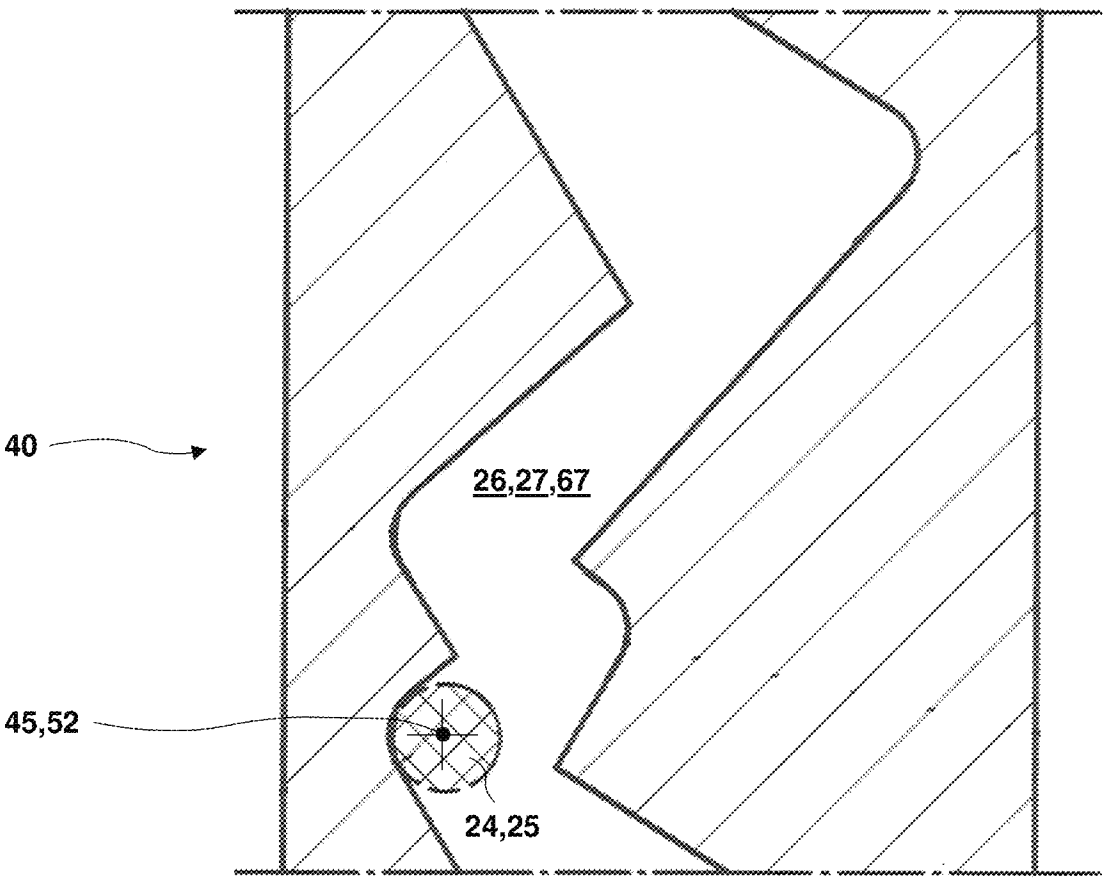
FIG. 8 shows a developed view of the motion link unit of the winding machine fixing mechanism of the winding machine according to FIGS. 1, 3, 5 and 7, wherein the motion link body is located in a fourth axial position of the motion link.

If at the end of the winding cycle the winding sleeve 4 with the winding 59 is to be removed from the winding spindle 3, the winding machine fixing mechanism 44 must first be transferred to the position for sliding on shown in FIGS. 7 and 8. For this purpose, a force for sliding on 60 is applied to the winding sleeve 4 and/or the winding 59, that results in a movement of the catch 5 while increasing the bias of the actuating spring 9. This movement of the catch 5 is transmitted via the catching pins 13 to the actuating part 43 and thus also to the motion link body 24, so that the motion link body 24 is transferred from the third axial position 51 according to FIG. 6 to the fourth axial position 52 according to FIG. 8. During this sliding on movement, the distance of the actuating surface 53 of the actuating sleeve 22 from the spreading element 32 already increases, allowing the fixing elements 36 to slide radially inwards again along the slanted surface 33 of the spreading element 32 until, in the release position shown in FIG. 7, the fixing sections 54*a*, 54*b* again comprise a radial distance from the longitudinal axis 6 that is smaller than the inner radius of the winding sleeve 4.

Figure 9:
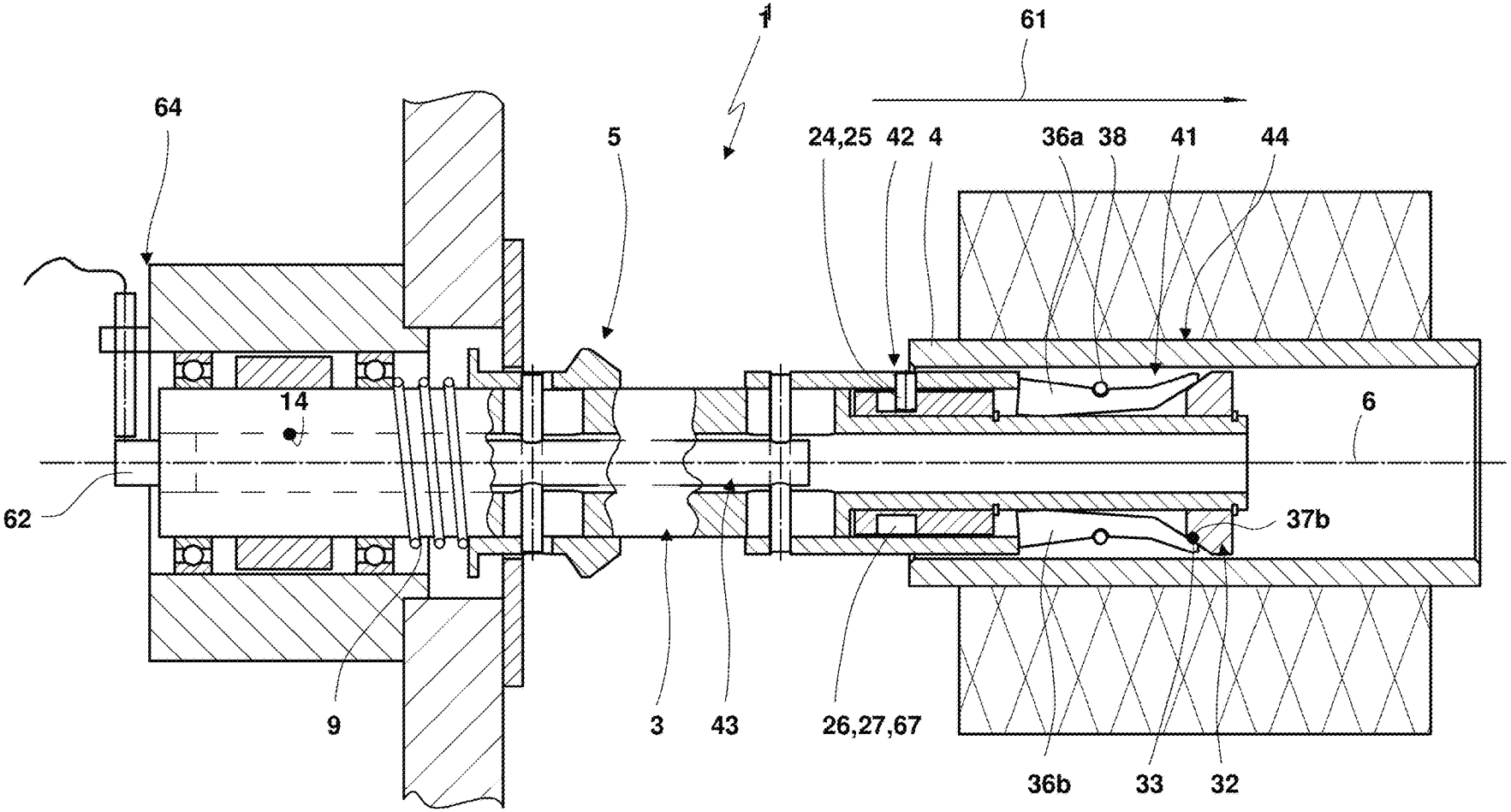
FIG. 9 shows the winding machine according to FIGS. 1, 3, 5 and 7 during the removal of the winding spindle with the winding wound on it from the winding spindle.
Figure 10:
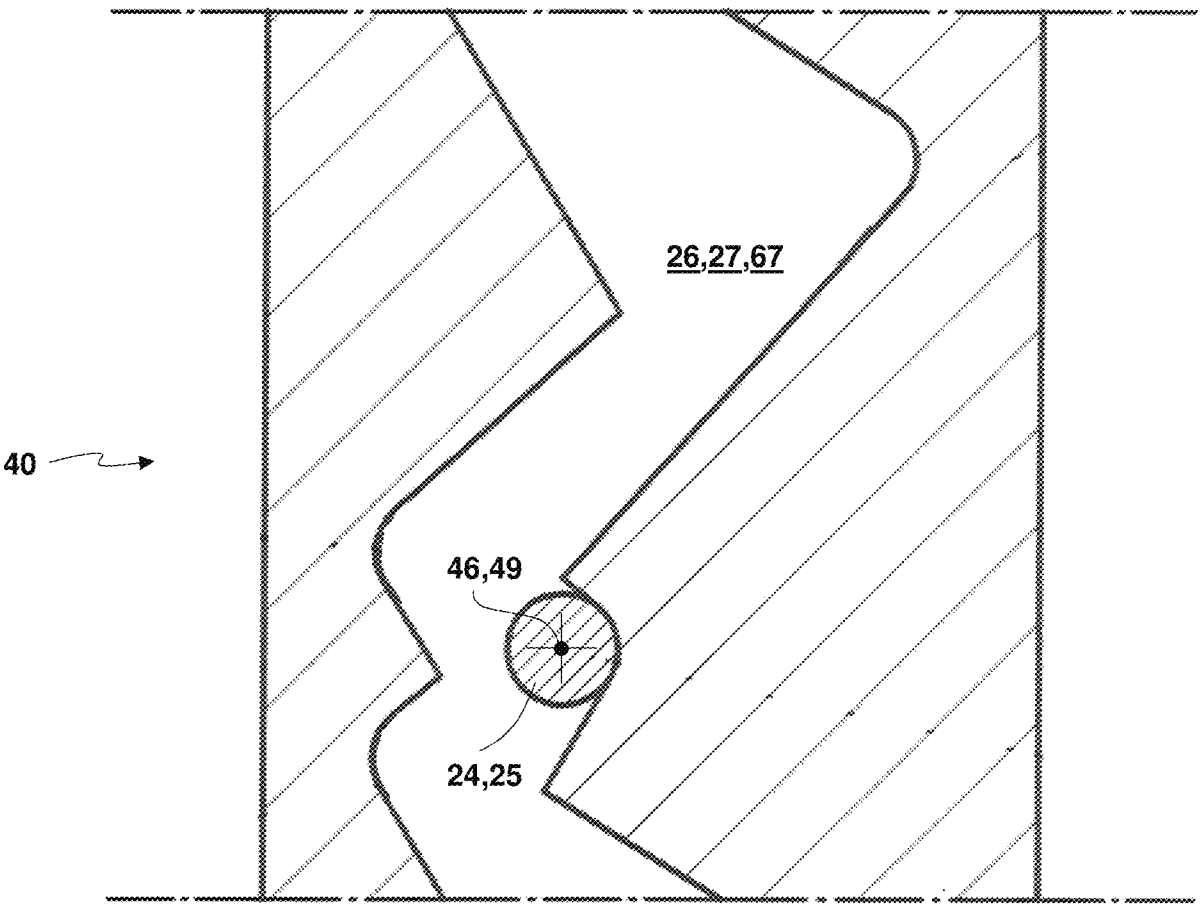
FIG. 10 shows a developed view of the motion link unit of the winding machine fixing mechanism of the winding machine according to FIGS. 1, 3, 5, 7 and 9, wherein the motion link body is again located in the first axial position of the motion link.

In this state, the force for sliding on 60 is eliminated and with a movement of the winding sleeve 4 in a direction for sliding off 61, the winding sleeve 4 with the winding 59 arranged thereon can be slid off the winding spindle 3 (FIG. 9). As a result of the removal of the force for sliding on 60, the actuating spring 9 can move the motion link body 24 in the circumferential motion link 27 from the fourth axial position 52 according to FIG. 8 to the first axial position 49 according to FIG. 10.

The movement of the motion link body 24 along the circumferential motion link 27 (in addition to the change in the axial position between the first axial position 49, the second axial position 50, the third axial position 51, the fourth axial position 52 and again the first axial position 49) is associated with a rotary movement of the motion link sleeve 28 relative to the winding spindle 3 on the one hand and to the actuating sleeve 22 on the other hand about the longitudinal axis 6, for which purpose a corresponding slide bearing is provided. Here, the extent of the rotary movement depends on the angle of inclination or the slope of the boundaries of the circumferential motion link 27.

As an optional particularity, an end region 62 of the actuating rod 15 protrudes from the end region of the winding spindle 3 mounted in the machine frame 2. Here, a distance 63 that the end region 62 protrudes from the winding spindle 3 depends on the operating position of the winding machine fixing mechanism 44:

In the release position according to FIGS. 1 and 2 as well as 9 and 10, i.e. in the first axial position 49, the end region 62 protrudes from the winding spindle 3 with a distance 63 of the length X. In the sliding on positions, i.e. the second axial position 50 and fourth axial position 52 according to FIGS. 3 and 4 as well as FIGS. 7 and 8, the end region 62 protrudes from the winding spindle 3 at a distance 63 with a length Y. Finally, in the fixing position according to FIGS. 5 and 6, i.e. in the third axial position 51, the end region 52 protrudes from the winding spindle 3 at a distance 63 with a length Z. Z>X>Y applies here.

Fixing a winding sleeve 4 on the winding spindle 3 by the winding machine fixing mechanism 44 is achieved by a sliding on stroke, for which a force for sliding on 57 is applied to the winding sleeve 4 and the winding sleeve 4 is moved in the direction of the catch 5, and by an actuating stroke, in which (with elimination of the force for sliding on 57) an opposite movement is caused by the actuating spring 9 and a transfer of the fixing device 41 from the release position into the fixing position is achieved.

Transferring the winding machine fixing mechanism 44 from the fixing position to the release position to remove the winding sleeve 4 with the winding 59 from the winding spindle 3 requires a sliding on stroke, in which a force for sliding on 60 is applied to the winding sleeve 4 and/or the winding 59 and the winding sleeve 4 is moved in the direction of the catch 5, and a subsequent actuating stroke after removal of the force for sliding on 60, in which a transfer of the fixing device 41 into the release position is induced by the actuating spring 9.

Accordingly, both the transfer of the winding machine fixing mechanism 44 into the fixing position and the actuation of the winding machine fixing mechanism 44 into the release position is induced by the actuating spring 9, the different directions of action of the actuating spring 9 with respect to the winding machine fixing mechanism 44 being provided by the design of the circumferential motion link 27.

The different distances 63 can be detected by a sensor 64, that can detect the displacement or the speed of the end region 62. It is possible that the sensor here detects the distance 63 continuously or in steps or digitized. It is also possible that the sensor 64 is a switch with at least 2 switching positions, that is switched over when reaching the predetermined distances 63, in particular the distances X, Y, Z.

As can be seen in FIG. 1, the winding spindle 3 with the catch 5 protrudes from the machine frame 2 through an opening 65. The space between the winding spindle 3 and the catch 5 and the boundary of the opening 65 can be closed by a covering or sealing 66. On the one hand, by the covering or sealing 66 dirt particles can be kept away from the machine frame 2 and the interior including the bearing for the winding spindle 3. Furthermore, it can be prevented that actuating elements or even the fingers of an operator's hand can enter this space. In the simplest case, the covering or sealing 66 can be embodied in the form of a plate, possibly with a gap seal or labyrinth seal opposite the lateral surface of the catch 5. Preferably, the covering or sealing 66 is trapped between extended end regions of the catch 5 on the one hand for providing the supporting surface 8 and on the other hand for providing the contact surface 10. In this case, the covering or sealing 66 can be embodied separately.

The accommodation of the catching pins 13 in elongated holes 12 of the catching sleeve 7 ensures a limited degree of freedom or play, which can be used for a compensation of differences in length of the winding sleeves 4. Such differences in length can for example be caused by manufacturing tolerances or due to wear.

Many variations and modifications may be made to the preferred embodiments of the invention without departing substantially from the spirit and principles of the invention. All such modifications and variations are intended to be included herein within the scope of the present invention, as defined by the following claims.

I claim:

1. A winding machine fixing mechanism for fixing a winding sleeve on a winding spindle comprising a) a fixing position and a release position, b) a motion control which actuates the winding machine fixing mechanism from the release position to the fixing position and from the fixing position to the release position, c) a fixing device which fixes the winding sleeve on the winding spindle and d) a catch which causes an actuation of the winding machine fixing mechanism and which is entrained by the movement of the winding sleeve during the motion control, e) the fixing device comprising at least one spreading element and at least one fixing element, f) the spreading element and the fixing element bearing against one another via at least one slanted surface, g) a movement of the catch causing a relative movement of the spreading element and the fixing element, the relative movement being guided by the slanted surface, the relative movement leading to a change of a distance of the fixing element from a longitudinal axis of the winding spindle, h) the fixing element comprising a fixing section that, after the winding sleeve has been slid on, is arranged behind the winding sleeve in a direction for sliding on, the fixing section being arranged radially outside of an inner diameter of the winding sleeve, i) the fixing section forming an axial stop for the winding sleeve that opposes or blocks a withdrawal of the winding sleeve from the winding spindle.

2. The winding machine fixing mechanism of claim 1, wherein in the fixing position:

a) an end region of the winding sleeve is supported on the catch in one axial direction and b) an other end region of the winding sleeve is supported on the fixing device in an other axial direction.

3. The winding machine fixing mechanism of claim 2, wherein the fixing device comprises multiple fixing elements distributed over a circumference of the winding spindle, pressed radially inwards against an outer surface of the winding spindle by a spring device and comprising slanted surfaces in an end region that interact with the spreading element.

4. The winding machine fixing mechanism of claim 1, wherein the catch is supported by an actuating spring that a) is biased by a movement of the winding sleeve in a direction for sliding on by a force for sliding on exerted by the winding sleeve on the catch and b) actuates the fixing device.

5. The winding machine fixing mechanism of claim 1, wherein a motion link unit is arranged in a force flow between the catch and the fixing device.

6. The winding machine fixing mechanism of claim 5, wherein the motion link unit comprises a ballpen motion link.

7. The winding machine fixing mechanism according to claim 5, wherein the motion link unit comprises a motion link and a motion link body moving along the motion link, wherein the motion link unit defines a first axial position of the motion link body, in which the fixing device is in the release position and in which the winding sleeve can be moved onto the winding spindle and can be moved by the winding spindle, defines a second axial position of the motion link body, in which the catch is entrained by the winding sleeve, defines a third axial position of the motion link body, in which the fixing device is in the fixing position, and defines a fourth axial position of the motion link body, in which the catch is entrained by the winding sleeve.

8. The winding machine fixing mechanism of claim 7, wherein movements from the first axial position into the second axial position and from the third axial position into the fourth axial position are caused by the movement of the winding spindle in the direction for sliding on and the movements from the second axial position into the third axial position and from the fourth axial position into the first axial position are caused by the actuating spring.

9. The winding machine fixing mechanism of claim 8, wherein in the first and third axial positions, a distance of the catch from the spreading element is larger than in the second and fourth axial positions.

10. The winding machine fixing mechanism of claim 9, wherein the motion link is a circumferential motion link and a rotation of a circumferential motion link takes place during the movements between the axial positions.

11. The winding machine fixing mechanism of claim 5, wherein the catch is coupled to at least one of the motion link unit and the fixing device by an actuating part and a sensor is provided which senses a position or a movement of the actuating part.

12. The winding machine fixing mechanism of claim 11, wherein the actuating part comprises an actuating rod that comprises an end region that extends at least temporarily out of an inner bore of the winding spindle, wherein the sensor senses the position or the movement of the end region projecting from the inner bore of the winding spindle.

13. The winding machine fixing mechanism of claim 1, wherein the catch is coupled to the fixing device by a rigid actuating part comprising a catching pin, an actuating rod and an actuating sleeve, the actuating part being axially movable relative to the winding spindle but rotating with the winding spindle, the winding spindle having an inner bore and the actuating rod extending inside the inner bore.

14. The winding machine fixing mechanism of claim 1, wherein a) the catch is mechanically coupled to an actuating sleeve, b) a plurality of fixing elements is provided, c) a front face of the actuating sleeve contacts associated axial front faces of the fixing elements, so that the front face of the actuating sleeve forms an actuating surface, and d) a spring device surrounds the fixing elements, which presses the fixing elements radially inwards against the lateral surface of the winding spindle such that the fixing elements contact the lateral surface of the winding spindle.

15. The winding machine fixing mechanism of claim 1, wherein in a fixing position of the winding machine fixing mechanism the winding sleeve is axially clamped between the catch and the fixing element, the catch comprising a contact surface being embodied as a contact cone, the inner surface of the winding sleeve being free of contact between the end portions of the winding sleeve contacted by the contact cone of the catch and by the fixing element.

16. The winding machine fixing mechanism of claim 1, wherein a) in the fixing position one end region of the winding sleeve is supported on the catch in one axial direction, b) in the fixing position another end region of the winding sleeve is supported on the fixing device in another axial direction, c) the fixing device comprises multiple fixing elements distributed over a circumference of the winding spindle and d) the spreading element has a first slanted surface and the fixing elements have a fixing section with a second slanted surfaces shaped to correspond to the first slanted surface of the spreading element, the first slanted surface and the second slanted surfaces having the same angles of inclination and the first and second slanted surfaces sliding along each other for a change between the fixing position and the release position.

17. The winding machine fixing mechanism of claim 16, wherein the fixing section is clamped between the end portion of the winding sleeve and the spreading element.

18. A winding machine comprising a winding machine fixing mechanism for fixing a winding sleeve on a winding spindle comprising a) a fixing position and a release position, b) a motion control which actuates the winding machine fixing mechanism from the release position to the fixing position and from the fixing position to the release position, c) a fixing device which fixes the winding sleeve on the winding spindle and d) a catch which causes an actuation of the winding machine fixing mechanism and which is entrained by a movement of the winding sleeve during the motion control, e) the fixing device comprising at least one spreading element and at least one fixing element, f) the spreading element and the fixing element bearing against one another via at least one slanted surface, g) a movement of the catch causing a relative movement of the spreading element and the fixing element, the relative movement being guided by the slanted surface, the relative movement leading to a change of a distance of the fixing element from a longitudinal axis of the winding spindle, h) the fixing element comprising a fixing section that, after the winding sleeve has been slid on, is arranged behind the winding sleeve in a direction for sliding on, the fixing section being arranged radially outside of an inner diameter of the winding sleeve, i) the fixing section forming an axial stop for the winding sleeve that opposes or blocks a withdrawal of the winding sleeve from the winding spindle.

19. The winding machine of claim 18, wherein the catch is coupled to the fixing device by a rigid actuating part comprising a catching pin, an actuating rod and an actuating sleeve, the actuating part being axially movable relative to the winding spindle but rotating with the winding spindle, the winding spindle having an inner bore and the actuating rod extending inside the inner bore.

20. The winding machine of claim 18, wherein a) the catch is mechanically coupled to an actuating sleeve, b) a plurality of fixing elements is provided, c) a front face of the actuating sleeve contacts associated axial front faces of the fixing elements, so that the front face of the actuating sleeve forms an actuating surface, and d) a spring device surrounds the fixing elements, which presses the fixing elements radially inwards against the lateral surface of the winding spindle such that the fixing elements contact the lateral surface of the winding spindle.

21. The winding machine of claim 18, wherein in a fixing position of the winding machine fixing mechanism the winding sleeve is axially clamped between the catch and the fixing element, the catch comprising a contact surface being embodied as a contact cone, the inner surface of the winding sleeve being free of contact between the end portions of the winding sleeve contacted by the contact cone of the catch and by the fixing element.

22. The winding machine of claim 18, wherein a) in the fixing position one end region of the winding sleeve is supported on the catch in one axial direction, b) in the fixing position another end region of the winding sleeve is supported on the fixing device in another axial direction, c) the fixing device comprises multiple fixing elements distributed over a circumference of the winding spindle and d) the spreading element has a first slanted surface and the fixing elements have a fixing section with a second slanted surfaces shaped to correspond to the first slanted surface of the spreading element, the first slanted surface and the second slanted surfaces having the same angles of inclination and the first and second slanted surfaces sliding along each other for a change between the fixing position and the release position.

23. The winding machine fixing mechanism of claim 22, wherein the fixing section is clamped between the end portion of the winding sleeve and the spreading element.

24. A winding machine fixing mechanism for fixing a winding sleeve on a winding spindle comprising a) a catch which aa) causes an actuation of the winding machine fixing mechanism from a release position to a fixing position, ab) is entrained by a movement of the winding sleeve when pushing the winding sleeve onto the winding spindle and ac) is mechanically coupled to a fixing element such that a movement of the catch causes a movement of the fixing element, b) wherein in the fixing position of the winding machine fixing mechanism the winding sleeve is axially clamped between a contact surface of the catch and an inclined contact surface of the fixing element, wherein the contact surface of the catch is embodied as a contact cone, an inner surface of the winding sleeve being free of contact with the winding spindle between an end portion of the winding sleeve contacted by the contact surface of the catch and an end portion of the winding sleeve contacted by the inclined contact surface of the fixing element.

25. A winding machine comprising a winding machine fixing mechanism for fixing a winding sleeve on a winding spindle comprising a) a catch which aa) causes an actuation of the winding machine fixing mechanism from a release position to a fixing position, ab) is entrained by a movement of the winding sleeve when pushing the winding sleeve onto the winding spindle and ac) is mechanically coupled to a fixing element such that a movement of the catch causes a movement of the fixing element, b) wherein in the fixing position of the winding machine fixing mechanism the winding sleeve is axially clamped between a contact surface of the catch and an inclined contact surface of the fixing element, wherein the contact surface of the catch is embodied as a contact cone, an inner surface of the winding sleeve being free of contact with the winding spindle between an end portion of the winding sleeve contacted by the contact surface of the catch and an end portion of the winding sleeve contacted by the inclined contact surface of the fixing element.

* * * * *